United States Patent [19]

Panecki et al.

[11] Patent Number: 4,908,489

[45] Date of Patent: Mar. 13, 1990

[54] INDUCTION HEATING DRIVER CIRCUIT

[75] Inventors: Frank Panecki, St. Clair; Timothy Satawa, Roseville; Leon Brank, Roseville, Mich.

[73] Assignee: Food Rethermalization Ltd., Southfield, Mich.

[21] Appl. No.: 176,267

[22] Filed: Mar. 31, 1988

[51] Int. Cl.[4] ..... H05B 6/06

[52] U.S. Cl. ..... 219/10.77; 219/10.493; 363/49; 323/901

[58] Field of Search ..... 219/10.77, 10.493; 363/49, 97, 136; 323/901

[56] References Cited

U.S. PATENT DOCUMENTS

| | | | |
|---|---|---|---|
| Re. 30,623 | 5/1981 | Schultz et al. | 165/48 |
| 2,625,242 | 1/1965 | Reed | 186/1 |
| 3,079,913 | 3/1965 | Nelson | 126/390 |
| 3,294,946 | 12/1966 | Baermann | 219/10.49 |
| 3,608,627 | 9/1971 | Shevlin | 165/2 |
| 3,745,290 | 7/1973 | Harnden, Jr. | 219/10.49 |
| 3,777,094 | 12/1973 | Peters, Jr. | 219/10.49 |
| 3,781,503 | 12/1973 | Harnden, Jr. | 219/10.49 |
| 3,786,222 | 1/1974 | Harnden, Jr. | 219/10.49 |
| 3,790,735 | 2/1974 | Peters, Jr. | 219/10.49 |
| 3,843,857 | 10/1974 | Cunningham | 219/10.49 |
| 3,887,253 | 6/1975 | Bridges et al. | 312/250 |
| 3,908,749 | 9/1975 | Williams | 165/2 |
| 3,944,100 | 12/1975 | Mack et al. | 219/386 |
| 4,005,745 | 2/1975 | Colato et al. | 165/2 |
| 4,016,390 | 4/1977 | Amagami | 219/10.493 |
| 4,020,310 | 4/1977 | Souder et al. | 219/10.49 |
| 4,087,142 | 6/1978 | Aumack | 312/236 |
| 4,103,736 | 8/1978 | Colato et al. | 165/48 |
| 4,110,587 | 8/1978 | Souder, Jr. | 219/10.49 |
| 4,180,125 | 12/1979 | Schultz et al. | 165/48 |
| 4,194,109 | 3/1980 | Springer | 219/386 |
| 4,254,824 | 3/1981 | Springer | 165/64 |
| 4,285,391 | 8/1981 | Bourner | 165/30 |
| 4,438,311 | 3/1984 | Tazima et al. | 219/10.77 X |
| 4,560,851 | 12/1985 | Tsukamoto et al. | 219/10.77 |
| 4,564,733 | 1/1986 | Karklys | 219/10.77 |
| 4,625,271 | 11/1986 | Chetty et al. | 363/49 |
| 4,638,418 | 1/1987 | Alexander | 363/49 |
| 4,698,743 | 10/1987 | Onodera et al. | 363/49 X |

*Primary Examiner*—Philip H. Leung
*Attorney, Agent, or Firm*—Krass & Young

[57] ABSTRACT

The present invention is an improved induction heating apparatus and more particularly a improved oscillation control circuit. The induction heating apparatus includes at least one induction coil, with a parallel capacitance forming an LC oscillation circuit. A set of at least one semiconductor switching devices enables a power source to be coupled to the LC oscillation circuit. This power source is preferably a half wave rectified AC voltage. A control circuit periodically switches ON the semiconductor switching devices to couple the half wave rectified AC voltage to the LC oscillation circuit thereby stimulating electrical oscillations. The control circuit includes an initialization circuit for inhibiting the first coupling of the half wave rectified AC voltage to the LC oscillation circuit while the half wave rectified AC voltage is greater than a predetermined amount. In the preferred embodiment this is achieved by delaying this initial energization until a leading edge of a pulse of the half wave rectified AC voltage. This serves to protect the semiconductor switching devices from possible initial overcurrent conditions.

10 Claims, 3 Drawing Sheets

INDUCTION HEATING DRIVER CIRCUIT

TECHNICAL FIELD OF THE INVENTION

The technical field of the present invention is that of induction heating circuits and particularly oscillatory driving circuits for such induction heating circuits.

BACKGROUND OF THE INVENTION

It has previously been proposed to reheat food products employing induction heating of elements within the food container. Such techniques known in the prior art are exemplified by U.S. Pat. No. 4,020,310 entitled "Container for Inductively Heating Food" issued to Souder, Jr. et al. on Apr. 26, 1977, and U.S. Pat. No. 4,110,587 entitled "Method and Apparatus for Heating Food" issued to Souder, Jr. et al. on Aug. 29, 1978, which is a divisional application of U.S. Pat. No. 4,020,310.

In the systems exemplified by the above noted U.S. Patents an oscillatory signal is induced in a fixed induction coil. This oscillatory signal generates magnetic fields which cause an induced current within an electrically conductive material integrated within the container for storage of the food. This induced electric current causes self-heating of this electrically conductive material, thereby permitting warming of the food.

In a practical environment of this invention a movable cabinet includes a plurality of such fixed induction coils at numerous shelf locations. In the preferred embodiment these induction coils are disposed at less than all of the possible shelf locations. The interior space of this movable cabinet is ordinarily kept refrigerated. Food which is not to be heated is placed within containers which do not have the electrically conductive material. These containers may be placed any where within the cabinet even at shelf locations having one of the fixed induction coils. The food will then be cooled by the refrigeration of the movable cabinet. Food to be heated is placed within the specially formed containers having the electrically conductive material, these specially formed containers being further placed at a shelf location having one of the fixed induction coils. The induction heating coil induces a current within the electrically conductive material causing electrical self-heating and warming of the food. The degree to which food is heated is based upon the type of container, including the location and character of the electrically conductive material, if any, and upon whether or not the container is placed at a location having an induction coil. This technique enables food to be heated and food to be cooled to be kept in the same movable cabinet and does not require selective actuation of switches or the like to enable the heating.

A problem with such a technique for heating food is the stimulation of the oscillatory signal within the fixed induction coils. It would be of particular advantage to be able to transfer a maximum controlled amount of power from an electrical power source to such an induction coil. A typical system would include a capacitor connected to the induction coil in order to provide an LC oscillation circuit. Because of losses such a circuit must be periodically re-energized to ensure continued oscillation.

In accordance with the prior art it is known to periodically couple an electrical power supply to the LC oscillation circuit in order to re-energize this circuit. Bipolar or field effect switching transistors can be employed for this purpose. These devices have limitations. In particular, it has been found that the use of switching transistors carries a large risk of overcurrent destruction of these devices, particularly during the initial application of power to the LC oscillation circuit.

It is therefore a need in the art to be able to provide an induction heating driver circuit not having the limitations of the prior art.

DESCRIPTION OF THE INVENTION

The present invention employs at least one semiconductor switching device, such as a plurality of field effect switching transistors, to provide periodic energization of an LC oscillation circuit. In accordance with the present invention the semiconductor switching devices employed are protected from initial overcurrents by inhibiting the initial energization of the LC oscillation circuit while the applied voltage is greater than a predetermined amount.

In accordance with the preferred embodiment of the present invention the applied voltage to the LC oscillation circuit for energization is derived from a half wave rectified AC power source. The half wave rectified AC power is periodically applied to the LC oscillation circuit. This application occurs in a controlled manner whereby the voltage at a predetermined portion of the LC oscillation circuit is less than the voltage of the half wave rectified AC power supply. In addition, the subsequent energizations of the LC oscillation circuit occurs only during certain phase portions of the oscillation of the LC oscillation circuit. These two conditions ensure that the energization is applied at the proper time in relationship to the oscillatory phase of the LC oscillation circuit to ensure maximum energization of the LC oscillation circuit. In accordance with the preferred embodiment of the present invention, initial application of electrical power to the LC oscillation circuit is delayed until the rising edge of the next following pulse of the half wave rectified AC power source, thereby ensuring that the applied voltage and thus the current carried by the semiconductor switching devices is minimized.

BRIEF DESCRIPTION OF THE DRAWINGS

These and other aspects of the present invention will become clear from the foregoing description taken in conjunction with the drawings in which.

DETAILED DESCRIPTION OF THE PREFERRED EMBODIMENT

Figure 1:
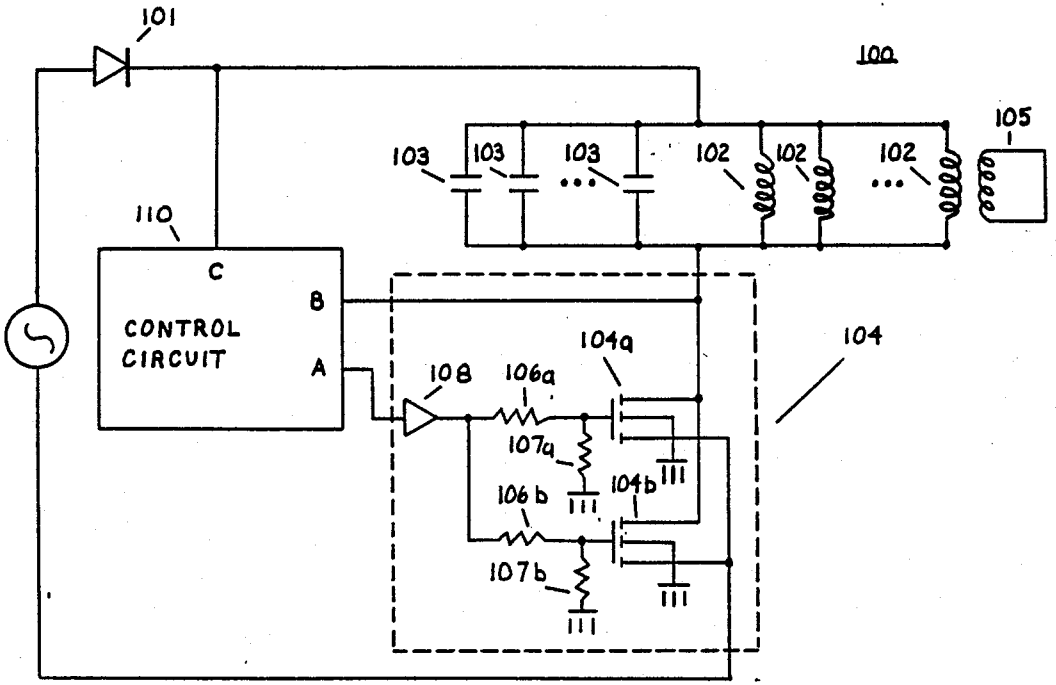
FIG. 1 illustrates in simplified schematic form the induction heating apparatus to which the present invention is applied.

FIG. 1 illustrates a simplified schematic diagram of the induction heating apparatus of the present invention. Electric power for providing the excitation of the induction heating system is derived from AC power source 10. This alternating current is rectified via diode 101. More than one semiconductor diode may be connected in parallel in order to provide the desired current capacity. A parallel LC oscillation circuit comprising a plurality of induction coils 102 and capacitors 103 provides the oscillatory signal for induction. In a practical embodiment of this invention the plurality of induction coils 102 would be disposed at various sites within the movable cabinet in order to induce currents within particular food containers.

At least one semiconductor switching device, here represented by field effect transistors 104*a* and 104*b* within switching circuit 104, couples the LC oscillation circuit formed of induction coils 102 and capacitors 103 to the half wave rectified AC power from diode 101. The switching circuit 104 is controlled by control circuit 110. It is contemplated that there may be a plurality of such switching circuits 104, each having one or more field effect transistors. The number of such circuits employed is selected to provide the current carrying capacity required by the number of induction coils 102 employed. Control circuit 110 provides a base bias via line A. In addition, sensing lines B and C are provided to control circuit 110 to control its operation. Lastly, also illustrated in FIG. 1, is shorted inductor 105. This shorted inductor 105 represents the electrically conductive material contained within one of the specially constructed food containers.

The circuit of FIG. 1 operates as follows. When the induction heating apparatus is switched on, control circuit 110 controls the on and off periods of field effect transistors 104*a* and 104*b* within switching circuit 104 via base line A. Base line A is coupled to a buffer device 108 which generates the necessary current to switch field effect transistors 104*a* and 104*b*. Each field effect transistor is driven by a voltage divider circuit, including resistors 106*a* and 107*a* for field effect transistor 104*a* and resistors 106*b* and 107*b* for field effect transistor 104*b*. These on and off periods of time are set via control circuit 110 in response to voltage feedback signals on lines B and C. These energizations are timed with regard to the oscillatory period of the half wave rectified AC power from diode 101 (sensed via line C) and the oscillatory period of the LC combination of induction coils 102 and capacitors 103 (sensed via line B). In accordance with the preferred embodiment of the present invention the oscillatory frequency f the LC oscillation circuit formed of induction coils 102 and capacitors 103 is in the neighborhood of 100 kilohertz. The energization of field effect transistors 104*a* and 104*b* is controlled by control circuit 110 to provide increasing energization to the oscillatory function of the LC oscillation circuit during the positive half cycle provided by diode 101. These periodic energizations can be likened to periodically pushing on a pendulum swing at the right time in its cycle in order to cause swings of increasing amplitude. During the negative half cycle of the AC power source 10, when diode 101 is cut off, no energization signals are applied to the LC oscillation circuit, and this circuit self oscillates. There are losses within the induction coils 102 and the capacitors 103. Indeed the energy for heating the food comes from losses in the LC oscillation circuit absorbed by the inductor 115 disposed in the food container. Because of these losses the oscillations are damped and eventually will cease. However, the next positive half cycle of AC power source 10 provides additional opportunities for energization of this LC oscillation circuit, thereby ensuring near continuous oscillations.

During this time the electrically conductive material within any special food container may be in proximity to the one of the induction coils 102. The changing magnetic fields within this induction coil 102 cause an induced electric current within the shorted inductor 105. As noted above, the shorted inductor 105 represents the electrically conductive material within the special food container. This induced electrical current causes resistive self heating within the electrically conductive material providing the heat for heating the food within the container. In the absence of such an electrically conductive material, the changing magnetic fields of the induction coil 102 would have no effect upon the food. Therefore, only food stored within containers including the electrically conductive material which are placed at shelf locations including an induction coil 102 would be heated, and all other food would be unaffected by this apparatus.

Figure 2:
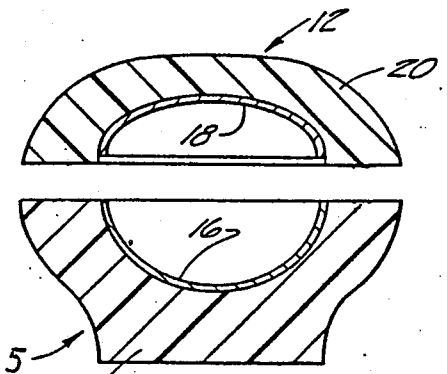
FIG. 2 illustrates a container for food useful in conjunction with the induction heating apparatus of the present invention.

FIG. 2 illustrates a container 5 for food of use with the induction heating apparatus of the present invention. Container 5 includes top 12 and base 14 forming a substantially nonconductive body 20. Container 5 also includes electrically conductive members 16 and 18, each of which correspond to shorted conductor 105 illustrated in FIG. 1. Induction coil 102 causes induced electrical currents within electrically conductive members 16 and 18, thereby heating these members and also heating any food contained within container 5.

Figure 3:
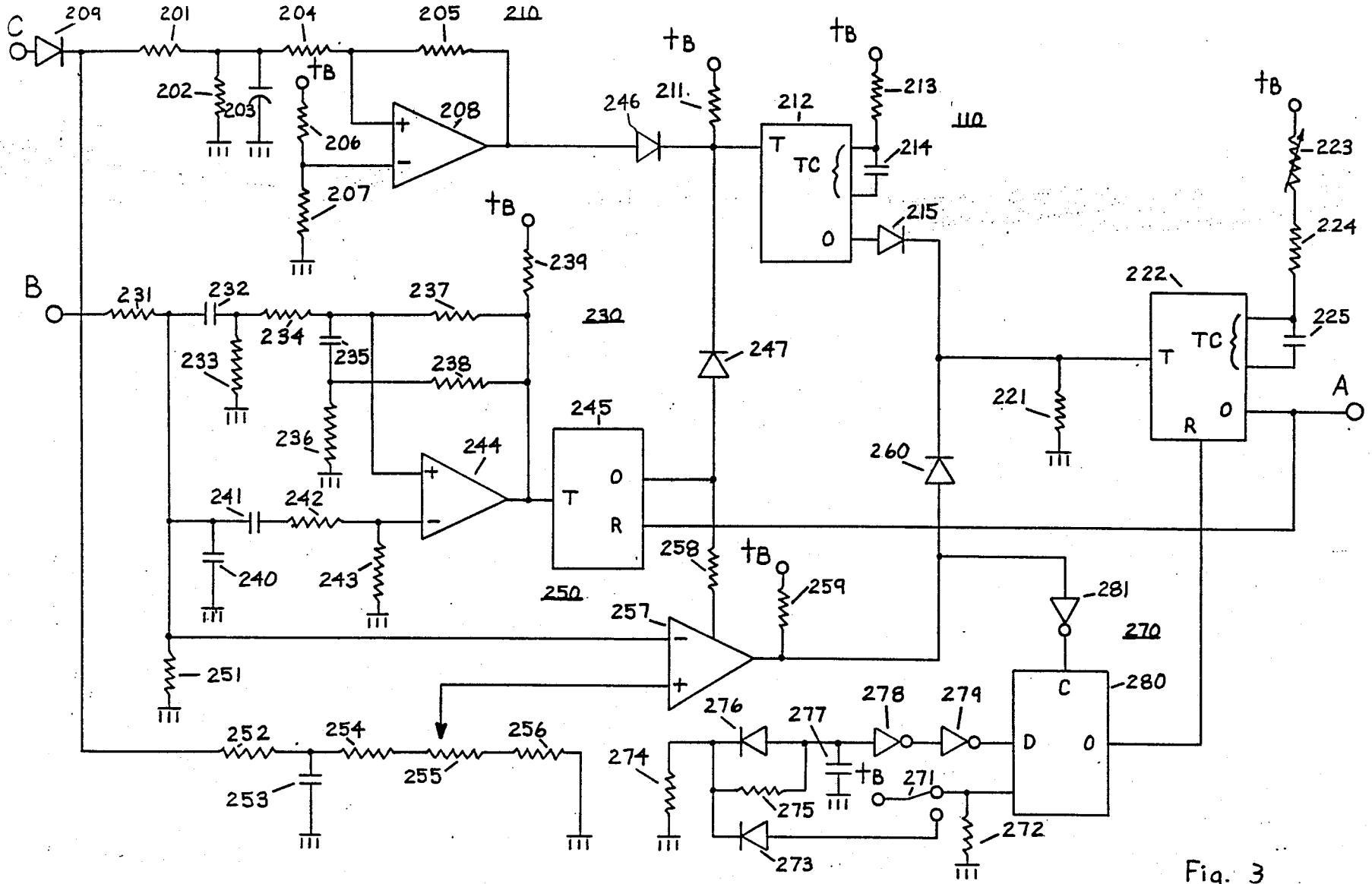
FIG. 3 illustrates in detailed schematic form the control circuit, illustrated in FIG. 1.

FIG. 3 illustrates in detailed schematic form control circuit 110 shown in FIG. 1. The schematic diagram illustrated in FIG. 3 includes terminals A, B and C which are connected to the respective lines A, B and C illustrated in FIG. 1. In general, control circuit 110 senses voltages at terminals B and C and provides the required base drive voltage at terminal A for application to the switching circuit 104.

Description of control circuit 110 will be made in regard to five sections: firstly, a DC voltage threshold trigger circuit 210; secondly, a triggering circuit 220; thirdly, an LC phase determination retrigger circuit 230; fourthly, a voltage comparison circuit 250; and fifthly, an initialization circuit 270.

The DC voltage threshold trigger circuit 210 serves to detect when the DC voltage at the anode of 101 is positive. The output from the diode 101 is applied via terminal C to diode 209 which provides isolation from the LC oscillation circuit. The signal from diode 209 is applied to the noninverting input terminal of operational amplifier 208 via a voltage divider circuit consisting of resistors 201, 202 and 204 and capacitor 203. This voltage is compared with a voltage derived from a voltage reference circuit connected between a DC power source (+B) and ground consisting of resistors 206 and 207. Resistor 205 provides feedback for operational amplifier 208, thereby regulating its gain. Operational amplifier 208 generates a pulse to the trigger input of triggerable one shot device 212 via diode 246 whenever the voltage from diode 101 is greater than the threshold set by resistors 206 and 207.

Triggerable one shot device 212 provides a short output at its output terminal when triggered via its trigger terminal. The length of time of this output is set by resistor 213 and capacitor 214 which are connected to the time constant inputs of triggerable one shot device 212. The output of triggerable one shot device 212 is provided to diode 215 which supplies an input to the trigger input of triggerable one shot device 222.

The trigger signal for switching circuit 104 is generated by triggering circuit 220. Triggering circuit 220 comprises generally a triggerable one shot circuit 222, which is similar to the triggerable one shot circuit 212 previously described. Upon receipt of an input signal at its trigger input, triggerable one shot device 222 generates a short output signal at its output, whose pulse length is determined by the components connected to its time constant input. Variable resistor 223, resistor 224 and capacitor 225 set the pulse width of the output of triggerable one shot device 222. In accordance with the preferred embodiment of the present invention, variable resistor 223 has a nominal resistance of 10 kilo ohms, resistor 224 has a resistance of 6.8 kilo ohms and capacitor 225 has a capacitance of 240 picofarads. This enables generation of a pulse width at the output of triggerable one shot device 222 on the order of three microseconds. As illustrated in FIG. 3, this is applied to terminal A which provides the base drive for field effect transistors 104*a* and 104*b*.

The LC phase determination retrigger circuit 230 provides a signal to retrigger triggerable one shot device 212 and hence to retrigger triggerable one shot device 222 upon detection of certain phase conditions of the oscillation of the LC oscillation circuit. Operational amplifier 244 triggers flip-flop 245 depending upon the conditions of the phase of the LC oscillation circuit. As illustrated in FIG. 3, there are two phase networks connected to the input point B via resistor 231. The first of these consists of capacitor 232, resistors 233 and 234, capacitor 235 and resistors 236, 237, 238 and 239. The second of these phase networks comprises capacitors 240 and 241 and resistors 242 and 243. These phase networks are connected to opposite inputs of operational amplifier 244. As a consequence, operational amplifier 244 generates an output signal to the clock input of flip-flop 245 when the phase of the oscillatory signal of the LC oscillation circuit is within a predetermined range of phases. The output of flip-flop 245 is connected to the input of triggerable one shot device 212 via diode 247. Diodes 246 and 247 together with resistor 211 form a wired OR circuit at the trigger input of triggerable one shot device 212. The output of triggerable one shot device 222 is applied to the reset input of flip-flop 245. Thus, regardless of the phase conditions of the oscillatory signal of the LC oscillation circuit, flip-flop 245 is reset whenever the LC oscillation circuit is re-energized via field effect transistor 104. This system provides a feedback permitting the LC oscillation circuit to be retriggered each time the phase reaches the predetermined phase of the LC phase determination retrigger circuit 230.

Voltage comparison circuit 250 compares the oscillatory voltage from the LC oscillation circuit to the output of diode 101. The voltage comparison circuit 250 ensures that the oscillatory voltage of the LC oscillation circuit is less than the voltage supplied by diode 101 when switching circuit 104 is triggered. Comparator 257 receives the half wave rectified AC voltage from diode 101 via input terminal C, diode 209 and the voltage divider consisting of resistor 252, capacitor 253, resistor 254, potentiometer 255, and resistor 256. This voltage is compared with the voltage from point B' via a voltage divider circuit comprising resistor 231 and resistor 251. Resistor 258 provides bias to comparator 257. The output of operational amplifier 257 is connected to the trigger input of triggerable one shot circuit 222 via resistor 259 and diode 260. This provides a manner of inhibiting the triggering of triggerable one shot device 222 unless the specified voltage conditions occur.

Initialization circuit 270 ensures that triggerable one shot circuit 222 is not energized upon initial application of electric power to control circuit 110, until specified conditions occur. The output of flip-flop 280 is connected to the reset input of triggerable one shot circuit 222. Therefore, triggerable one shot circuit 222 cannot be triggered until the output of flip-flop circuit 280 no longer resets this circuit. Initialization circuit 270 includes a delay circuit consisting of resistor 275 and capacitor 277. The diode 273 is employed to provide reverse bias protection. When switch 271 is switched to the ON position (not illustrated), thereby connecting +B to diode 273, capacitor 277 begins to charge. Inverters 278 and 279 form a buffer circuit which applies a low to the D input of flip-flop circuit 280 until the voltage across capacitor 277 exceeds the switching threshold of inverter 278. Thereafter, the opposite voltage is applied to the D input of flip-flop circuit 280. Diode 276 and resistor 274 are provided to ensure that capacitor 277 is discharged to zero when switch 271 is in the OFF position (illustrated). In accordance with the preferred embodiment of the present invention resistor 275 has a value of 39 kilo ohms and capacitor 277 has a value of 4.7 microfarads. This provides a time constant which is greater than the length of time of one of the voltage pulses from the diode 101.

Flip-flop 280 remains in the same state after expiration of this time period until operational amplifier 257 next detects the predetermined voltage conditions. With no oscillatory signal in the LC oscillation circuit, this occurs at the trailing edge of one of the pulses of the half wave rectified AC voltage. At this same time flip-flop 280 is clocked via inverter 281 thereby no longer applying the reset signal to triggerable one shot device 222. As a consequence, triggerable one shot device 222 is permitted to generate the switching signal for switching circuit 104 when it is next triggered by triggerable one shot device 212. This occurs at the leading edge of the next pulse of the half wave AC voltage. Thus the LC oscillation circuit is not energized until the next time DC voltage threshold trigger circuit 210 detects the leading edge of the half wave rectified AC voltage. This occurs after voltage comparison circuit 250 detects the predetermined relationship of the voltages after the expiration of this delay period. This technique is employed to ensure that the initial energization of the LC oscillation circuit occurs at a time when the voltage from diode 101 is at a minimum value, at the beginning of one of the pulses of the half wave rectified AC voltage.

This technique serves to eliminate the possibility of an overcurrent condition within field effect transistors 104*a* and 104*b* upon initial start up of the induction heating apparatus. If, for example, field effect transistors 104*a* and 104*b* are initially energized during a peak of the voltage from diode 101, particularly at a time when no current is flowing through the induction coils 102, then an excessive current may flow through these field effect transistors. This condition is prevented by preventing initial actuation of switching circuit 104 until the particular voltage condition detected by voltage comparison circuit 250 is detected. During subsequent energization of the LC oscillation circuit and in particular during energization of this circuit when the voltage from diode 101 is near its peak, currents are flowing through induction coils 102. These currents serve to produce a back electromotive force which prevents the conduction of excessive current through the field effect transistors 104*a* and 104*b*. No back electromotive force protects field effect transistors 104*a* and 104*b* upon initial actuation because no current then flows through inductor coils 102. This technique described above serves to protect field effect transistors 104*a* and 104*b* from the overcurrent conditions.

Figure 4:
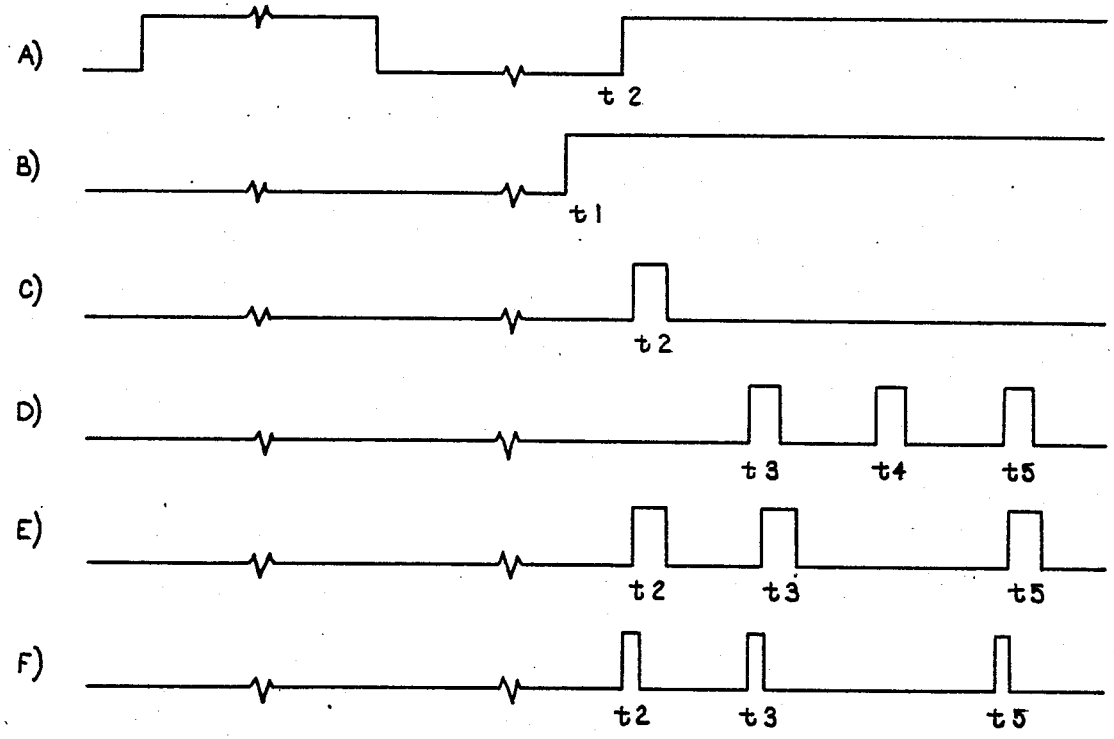
FIG. 4 illustrates examples of wave forms produced by the control circuit illustrated in FIG. 3.

FIG. 4 is a timing diagram which illustrates the operation of the circuit of FIG. 3. FIG. 4*a* illustrates the output of operational amplifier 208 which detects output of diode 101. Nothing happens prior to $t_1$ at which time flip-flop 280 releases from reset triggerable one shot device 222 (FIG. 4*b*). Prior to this time $t_1$ triggerable one shot device 222 is kept in the reset state and is incapable of generating the base drive signal at terminal A. A time $t_2$ operational amplifier 208 generates a signal indicating the positive going portion of the half wave rectified AC voltage from diode 101. As illustrated in FIG. 4*c*, triggerable one shot device 212 generates a short pulse which triggers triggerable one shot device 222. FIG. 4*d* illustrates the output from flip-flop 245. After each pulse from triggerable one shot device 222, flip-flop 245 is reset. Upon detection of the predetermined phase conditions by operational amplifier 244, flip-flop 245 generates a trigger signal to triggerable one shot device 212 to retrigger triggerable one shot device 222. These pulses occur at times $t_3$, $t_4$ and $t_5$. FIG. 4*e* illustrates the output from voltage comparator 250. During times $t_2$, $t_3$ and $t_5$ the relationship of the voltage of the LC oscillation circuit and the half wave rectified AC power from diode 101 is proper for triggering an additional energization of the LC oscillation circuit. This is illustrated by the pulses appearing at times $t_2$, $t_3$ and $t_5$ of FIG. 4*e*. Note that the triggerable one shot device 222 generates an output signal at times $t_2$, $t_3$ and $t_5$ (FIG. 4*f*) based upon the coincidence of the triggering signal from LC phase determination retrigger circuit 230 and voltage comparison circuit 250. During time $t_4$ there is no such coincidence so no energization of the LC oscillation circuit occurs at that time.

We claim:

1. An induction heating apparatus comprising:

at least one induction coil having first and second terminals;

a capacitance connected in parallel with said at least one induction coil;

a rectifier circuit adapted for connection to a source of alternating current electrical power for producing half wave rectified alternating current electrical power having a pulsating voltage;

at least one semiconductor switching device having a conducting state and a nonconducting state for selectively connecting said half wave rectified alternating current electrical power across said first and second terminals of said at least one induction coil;

a control circuit including a triggerable one shot circuit having a trigger input, a reset input and an output connected to said at least one semiconductor switching device for generating a predetermined voltage at said output for a predetermined trigger interval upon receipt of a trigger signal at said trigger input in the absence of a reset signal at said reset input, said predetermined voltage at said output placing said at least one semiconductor switching device in said conducting state for said predetermined trigger interval thereby stimulating electrical oscillation within the combination of said at least one induction coil and said capacitance;

a trigger circuit responsive to the voltage of said half wave rectified alternating current power source, and the voltage at said first terminal of said at least one induction coil, and connected to said trigger input of said trigger one shot circuit for generating a trigger signal for application to said trigger input of said triggerable one shot circuit upon detection of a predetermined relationship between the voltage of said half wave rectified alternating current power source and the voltage at said first terminal of said at least one induction coil, an initialization circuit responsive to said half wave rectified alternating current electrical power source and connected to said reset input of said trigger one shot circuit for generating said reset signal thereby inhibiting said trigger one shot circuit upon initial energization of said induction heating apparatus until the leading edge of one of the pulses of said pulsating voltage of said half wave rectified alternating current electrical power.

2. The induction heating apparatus as claimed in claim 1, further comprising:

a container for food including a substantially electrically nonconductive body having at least one electrically conductive member, whereby electrical currents are induced in said electrically conductive member thereby heating said electrically conductive member and food within said container when said container is disposed in proximity with said at least one induction coil.

3. The induction heating apparatus as claimed in claim 1, wherein:

said at least one semiconductor switching device consists of a plurality of field effect power transistors.

4. The induction heating apparatus as claimed in claim 1, wherein:

said at least one induction coil and said capacitance are selected whereby the frequency of said electrical oscillation within the combination of said at least one induction coil and said capacitance is approximately 100 kilohertz: and said predetermined trigger interval is approximately 3 microseconds.

5. The induction heating apparatus as claimed in claim 1, wherein:

said trigger circuit includes a first circuit connected to said first terminal of said at least one induction coil for generating a first signal during a predetermined phase of said electrical oscillation within the combination of said at least one induction coil and said capacitance;

a second circuit connected to said rectifier circuit and said first terminal of said at least one induction coil for generating a second signal when the voltage of said half wave rectified alternating current electrical power is greater than the voltage at said said first terminal of said at least one induction coil; and a third circuit connected to said trigger input of said trigger one shot circuit, said first circuit and said second circuit for generating said trigger signal upon receipt of both said first signal and said second signal.

6. The induction heating apparatus as claimed in claim 5, wherein:

said initialization circuit is connected to said second circuit and includes a predetermined delay upon initial energization for an interval of time longer than the period of pulsating voltage of said half wave rectified alternating current electrical power for generating said reset signal upon initial energization of said induction heating apparatus until the first occurrence of said second signal after expiration of said predetermined delay.

7. The induction heating apparatus as claimed in claim 1, wherein:

said trigger circuit includes a first circuit connected to said rectifier circuit for generating a first signal of a predetermined duration upon initial detection of the leading edge of one of the pulses of said pulsating voltage of said half wave rectified alternating current electrical power a second circuit connected to said first terminal of said at least one induction coil for generating a second signal during a predetermined phase of said electrical oscillation within the combination of said at least one induction coil and said capacitance;

a third circuit connected to said rectifier circuit and said first terminal of said at least one induction coil for generating a third signal when the voltage of said half wave rectified alternating current electrical power is greater than the voltage at said first terminal of said at least one induction coil; and a fourth circuit connected to said trigger input of said trigger one shot circuit, said first, second and third circuits for generating said trigger signal upon receipt of said first signal and upon receipt of both said second signal and said third signal.

8. The induction heating apparatus as claimed in claim 7, wherein:

said initialization circuit is connected to said third circuit and includes a predetermined delay upon initial energization for an interval of time longer than the period of pulsating voltage of said half wave rectified alternating current electrical power for generating said reset signal upon initial energization of said induction heating apparatus until the first occurrence of said third signal after expiration of said predetermined delay.

9. An induction heating apparatus comprising:

at least one induction coil having first and second terminals;

a capacitance connected in parallel with said at least one induction coil;

a rectifier circuit adapted for connection to a source of alternating current electrical power for producing half wave rectified alternating current electrical power having a pulsating voltage; and a control circuit connected to said at least one induction coil and said rectifier circuit for periodically coupling said half wave rectified alternating current electrical power across said first and second terminals of said at least one induction coil thereby stimulating electrical oscillation within the combination of said at least one induction coil and said capacitance, said control circuit including an initialization circuit responsive to said half wave rectified alternating current electrical power for inhibiting the first coupling of said source of half wave rectified alternating current electrical power across said first and second terminals of said at least one induction coil while the voltage of said half wave rectified alternating current electrical power is greater than a predetermined amount.

10. The induction heating apparatus as claimed in claim 9, further comprising:

a container for food including a substantially electrically nonconductive body having at least one electrically conductive member, whereby electrical currents are induced in said electrically conductive member thereby heating said electrically conductive member and food within said container when said container is disposed in proximity to said at least one induction coil.

* * * * *